United States Patent [19]

Lancaster et al.

[11] Patent Number: 4,738,079

[45] Date of Patent: Apr. 19, 1988

[54] METHOD AND APPARATUS FOR SEVERING PACKAGING MATERIAL BETWEEN SUCCESSIVE WRAPPED LOADS DURING A CONTINUOUS WRAPPING PROCESS

[75] Inventors: William G. Lancaster, Louisville; Philip R. Moore, Mt. Washington, both of Ky.

[73] Assignee: Lantech, Inc., Louisville, Ky.

[21] Appl. No.: 35,173

[22] Filed: Apr. 7, 1987

[51] Int. Cl.[4] ..... B65B 11/30

[52] U.S. Cl. ..... 53/450; 53/547; 53/548; 53/389; 83/326; 83/578

[58] Field of Search ..... 53/441, 450, 461, 547, 53/548, 550, 203, 389; 156/583.5; 83/578, 307.1, 326; 493/289

[56] References Cited

U.S. PATENT DOCUMENTS

| | | | |
|---|---|---|---|
| 2,023,291 | 12/1935 | Roth | 83/326 X |
| 2,359,403 | 10/1944 | Burt | 83/307.1 X |
| 3,549,462 | 12/1970 | Hollis | 156/583.5 |
| 3,869,844 | 3/1975 | Edouard | 53/548 X |
| 4,050,220 | 9/1977 | Lancaster et al. | 53/550 X |
| 4,317,322 | 3/1982 | Lancaster et al. | 53/441 X |

*Primary Examiner*—James F. Coan

*Attorney, Agent, or Firm*—Finnegan, Henderson, Farabow, Garrett & Dunner

[57] ABSTRACT

A method and apparatus is provided for severing packaging material which extends between successive wrapped loads during a continuous wrapping process. Wrapped loads are conveyed along a load path in a conveying direction. A severing bar which extends lateral to the conveying direction includes a heating element which is connected to a power source by an electrical conductor. A sprocket and chain drive is used to transport the severing bar along a closed path having first and second segments. The first segments generally extends lateral to the extent of the severing bar and has a component in the conveying direction. During the first segment of transport, severing bar is transported across the load path between and along with a first pair of successive loads. The second segment of the closed path generally extends lateral to the extent of the severing bar as a component in the conveying direction. During transport over the second segment, the severing bar is transported back across the load path between and along with the second pair of successive loads. A fixed support frame is used to support the chain and sprocket drive. A guide frame, guide follower and rotary bearing are used to prevent rotation between the severing bar and the fixed support frame and to prevent twisting of the electrical conductor during repeated transport of the severing bar around the closed path.

12 Claims, 6 Drawing Sheets

METHOD AND APPARATUS FOR SEVERING PACKAGING MATERIAL BETWEEN SUCCESSIVE WRAPPED LOADS DURING A CONTINUOUS WRAPPING PROCESS

BACKGROUND OF THE INVENTION

The present invention relates to a method and apparatus for severing packaging material, and more particularly, for severing packaging material which extends between successive wrapped loads during a continuous wrapping process.

Stretch wrapping is a method of wrapping loads with a tensioned web of packaging material such as stretch wrap film. An example of a method and apparatus for stretch wrapping is disclosed in U.S. Pat. No. 4,317,322 to Lancaster et al., assigned to Lantech, Inc., and is incorporated herein by reference.

Recently, developments in stretch wrapping have focused on methods and apparatus for continuously wrapping a series of loads in an uninterrupted manner. Such continuous wrapping involves conveying a series of loads through a wrapping area in which the loads are spirally wrapped with stretch wrap film. As a result, the series of wrapped loads become encased with a continuous tube of stretch wrap film. A severing bar, positioned downstream of the wrapping station, is passed between successive wrapped loads. The severing bar severs the tube of packaging material between successive wrapped loads and separates the wrapped loads.

As it has become possible to wrap at higher speeds, the conveying speed of the wrapped loads has also increased. To prevent the servering bar from striking the rapidly moving loads, it has become necessary to translate the severing bar in the conveying direction along with the loads while passing it between successive wrapped loads. In contrast to merely translating the severing bar back and forth along a single linear path, the requirement of translating the severing bar in the conveying direction with the loads during severing has required a system which transports the severing bar around a closed path having at least two different segments. Both segments have a component in the conveying direction. In the first segment, the severing bar passes across the load path between and along with a first pair of successive loads. In the second segment the severing bar returns across the load path between and along with a second pair of successive loads.

In order to reliably sever the packaging material on a prolonged and repeated basis, a heating element is incorporated in the severing bar to heat the severing bar so that the packaging material is melted or substantially weakened upon coming in contact with the severing bar. The heating element in the severing bar is supplied with electricity by an electrical conductor which is connected to a power source.

While the earlier linearly reciprocating severing bar did not twist the electrical conductor during operation, the more advanced systems, which transported the severing bar in the conveying direction along a closed path during the severing operation, would twist the electrical conductor in an unsatisfactory manner during repeated cycling of the severing bar along the closed path.

As a result, various commutator systems, such as those shown in FIGS. 2 and 3, were developed in order to conduct electricity from a fixed central point to the heating element in the severing bar as it proceeded around the closed path. The commutator systems prevented twisting of the electrical conductor during repeated cycling of the severing bar along the closed path.

However, during operation of the severing bar, the commutator systems are exposed to considerable forces, especially when the severing bar is changing directions. As a result of these forces and the high number of repetitions required in fast continuous packaging systems, the commutators failed and required replacement after a relatively short period of time.

Such need for frequent replacement of the commutators has greatly increased the expense of operating the continuous packaging systems. In addition to the cost of the parts and services, there can be significant losses in time, money and effectiveness during the periods of time during which the system is required to be idle due to such failures. As a result, the advantages obtained through the development of such sophisticated high speed wrapping machines have been substantially subverted by decreases in efficiency due to extended and repeated periods of downtime due to failures of the commutator systems.

Accordingly, it is an object of the present invention to provide a method and apparatus for severing packaging material in which electricity can be supplied to a heating element in a severing bar in a reliable and failureproof manner to prevent downtime and the need to service and replace parts.

It is a further object of the present invention to provide a method and apparatus for severing packaging material which in which the conductors for heating the severing bar are not twisted during repeated cycling of the severing bar around a closed path.

It is an additional object of the present invention to provide a method and apparatus for severing packaging material in a system which is simple to construct and easy to operate.

It is another object of the present invention to provide a method and apparatus for severing packaging material during a continuous wrapping process which does not require the use of commutators for preventing twisting of the conductor for the heating element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purposes of the invention as embodied and broadly described herein, there is provided an apparatus for severing packaging material which extends between successive wrapped loads during a continuous wrapping process. Conveying means are provided for conveying the wrapped loads along a load path in a conveying direction. Severing bar means extend lateral to said conveying direction for severing the packaging material which extends between the successive wrapped loads. The severing bar means include a heating element for heating the severing bar means to facilitate severing the packaging material. Electrical conductor means are connected to the heating element in the severing bar means for conducting electricity from a power source to the heating element in the severing bar means to heat the heating element.

Transport means are provided for translating the severing bar means along a closed path having first and second segments. The first segment generally extends lateral to the extent of the severing bar means and has a component in the conveying direction so that the the severing bar means passes across the load path between and along with a first pair of successive loads. The second segment generally extends lateral to the extent of the severing bar means and has a component in the conveying direction so that the severing bar means passes back across the load path between and along with a second pair of successive loads.

Fixed support frame means as provided for supporting the transport means, and means for preventing rotation between the severing bar means and the fixed support frame means are provided for preventing twisting of the electrical conductor means during repeated transport of the severing bar means around the closed path.

Rotary bearing means are preferably provided between the severing bar means and the transport means for permitting relative rotation between the severing bar means and the transport means.

BRIEF DESCRIPTION OF THE DRAWINGS

The accompanying drawings which are incorporated in and constitute part of the specification, illustrate a presently preferred embodiment of the invention and, together with a general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided an apparatus for severing packaging material which extends between successive wrapped loads during a continuous wrapping process comprising: conveying means for conveying the wrapped loads along a load path in a conveying direction; severing bar means extending lateral to said conveying direction for severing the packaging material which extends between the successive wrapped loads, the severing bar means including a heating element for heating the severing bar means to facilitate severing the packaging material; electrical conductor means connected to the heating element in the severing bar means for conducting electricity from a power source to the heating element in the severing bar means to heat the heating element; transport means for translating the severing bar means along a closed path having first and second segments, said first segment generally extending lateral to the extent of the severing bar means and having a component in the conveying direction for passing the severing means across the load path between and along with first pair of successive loads, said second segment generally extending lateral to the extent of the severing bar means and having a component in the conveying direction for passing the severing means back across the load path between and along with a second pair of successive loads; fixed support frame means for supporting the transport means; and means for preventing rotation between the severing bar means and the fixed support means for preventing twisting of the electrical conductor means during repeated transport of the severing bar means around the closed path.

Figure 1:
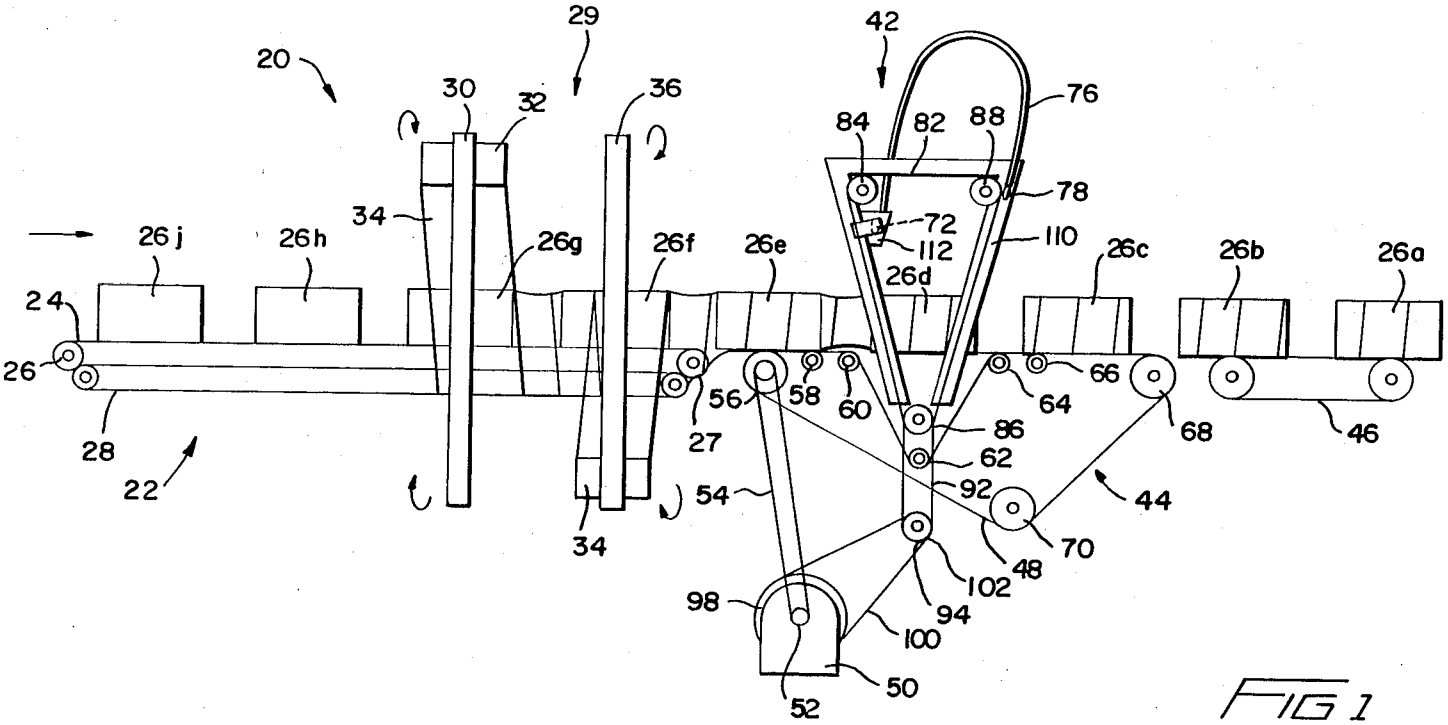
FIG. 1 is a side elevation view of stretch wrapping apparatus with an apparatus for severing packaging material which incorporates the teaching of the present invention.
Figure 2:
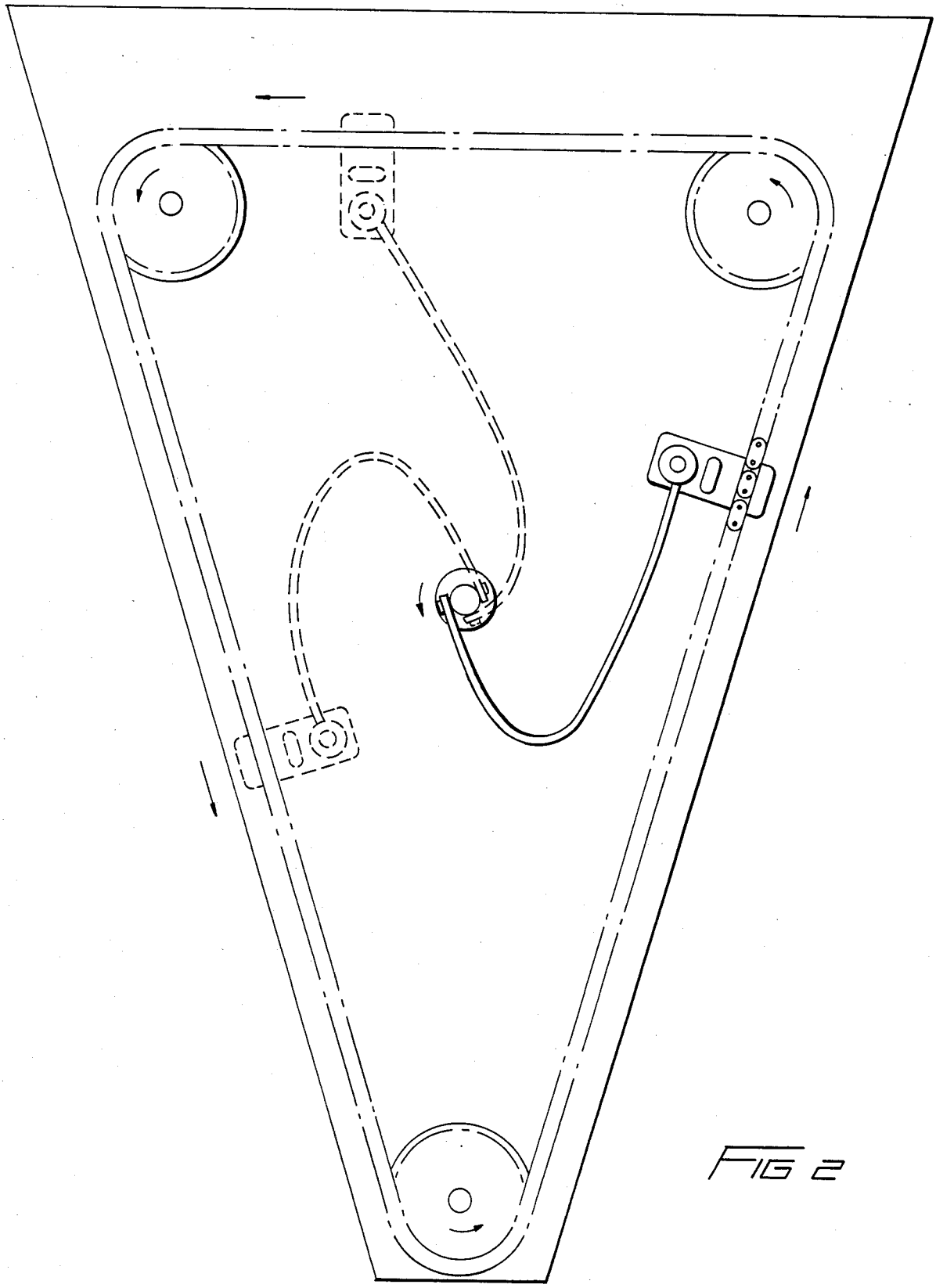
FIG. 2 is a partial side elevation view of an apparatus for severing packaging material which uses commutators to conduct electricity as described above.
Figure 3:
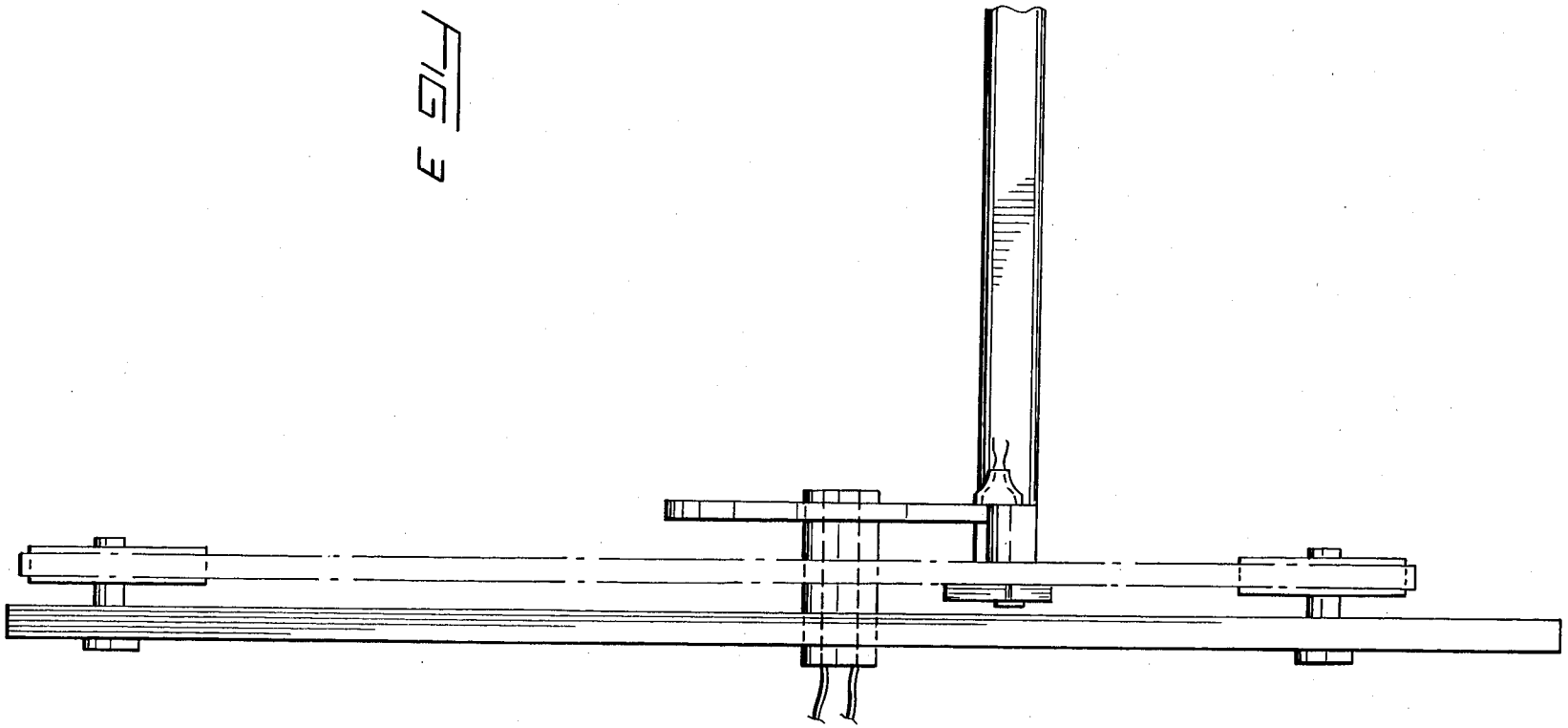
FIG. 3 is a partial end view of the apparatus shown in FIG. 2.

The apparatus of the present invention is shown in FIG. 1 as being incorporated in a continuous stretch wrapping apparatus 20. Stretch wrapping apparatus 20 includes an in-feed conveyor 22 having an endless in-feed belt 24 which is driven about pulleys 26 and 27 with an exposed horizontal surface for supporting and conveying a series of loads 26 in a downstream direction (to the right in FIG. 1). In addition, in-feed conveyor 22 includes a second belt 28, exposed on the lower surface of conveyor 22, which acts as a mandrel for receiving and transporting packaging material in a downstream direction during wrapping.

A wrapping station 29 is shown in FIG. 1. The wrapping station 29 includes a first rotating ring 30 which encircles both the in-feed conveyor and loads 26. A first roll 32 of stretch wrapping packaging material is carried by first rotating ring 30 around in-feed conveyor 22 and loads 26 to spirally wrap a first web 34 of stretch wrapping packaging material about in-feed conveyor 22 and loads 26. The wrapping station 29 also includes a second rotating ring 36 which encircles in-feed conveyor 22 and loads 26. Second rotating ring 36 rotates in a direction opposite the direction of rotation of first rotating ring 30, and carries a second roll 38 of stretch wrapping packaging material around in-feed conveyor 22 and loads 26, to spirally wrap in-feed conveyor and loads 26 with a second web 40 of stretch wrapping packaging material.

After passing the wrapping station 29, wrapped loads 26 proceed off the downstream end of in-feed conveyor 22. The wrapped material recovers from the downstream end of the mandrel onto the wrapped loads, and the wrapped loads continue to be conveyed downstream through a severing station 42 by a severing station conveyor 44. At severing station 42, the packaging material which extends between successive wrapped loads is severed so that the wrapped loads 26 are separated from each other. After the severing operation, the wrapped loads proceed to an out-feed conveyor 46 which transports wrapped loads to a location from where they can be prepared for shipping.

According to the present invention, there is provided conveying means for conveying the wrapped loads along a load path in a conveying direction. As shown in FIG. 1, the conveying means includes severing station conveyor 44. Severing station conveyor 44 includes a conveyor belt 48 which is driven by motor and reducer assembly 50. A first output shaft 52 of motor and reducer assembly 50 includes a sprocket which drives conveyor drive chain 54, which in turn drives conveyor belt 48 in a path around a series of rollers 56, 58, 60, 62, 64, 66, 68 and 70.

According to the present invention, there is provided severing bar means extending lateral to the conveying direction for severing the packaging material which extends between the successive wrapped loads. The severing bar means includes a heating element for heating the severing bar means to faciliate severing the packaging material.

Figure 4:
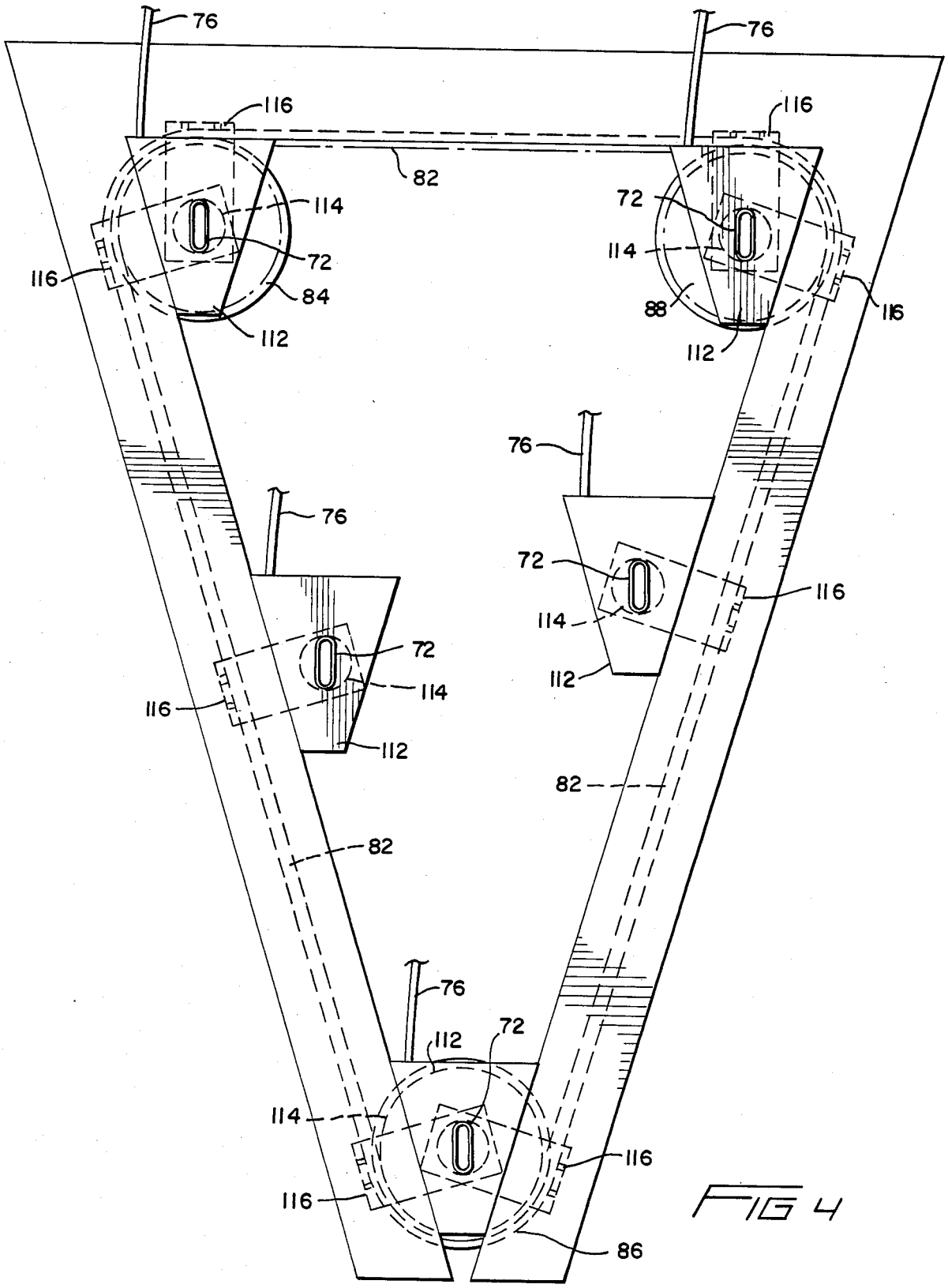
FIG. 4 is enlarged partial side elevation view of the severing apparatus illustrated in FIG. 1 in several positions of operation.
Figure 5:
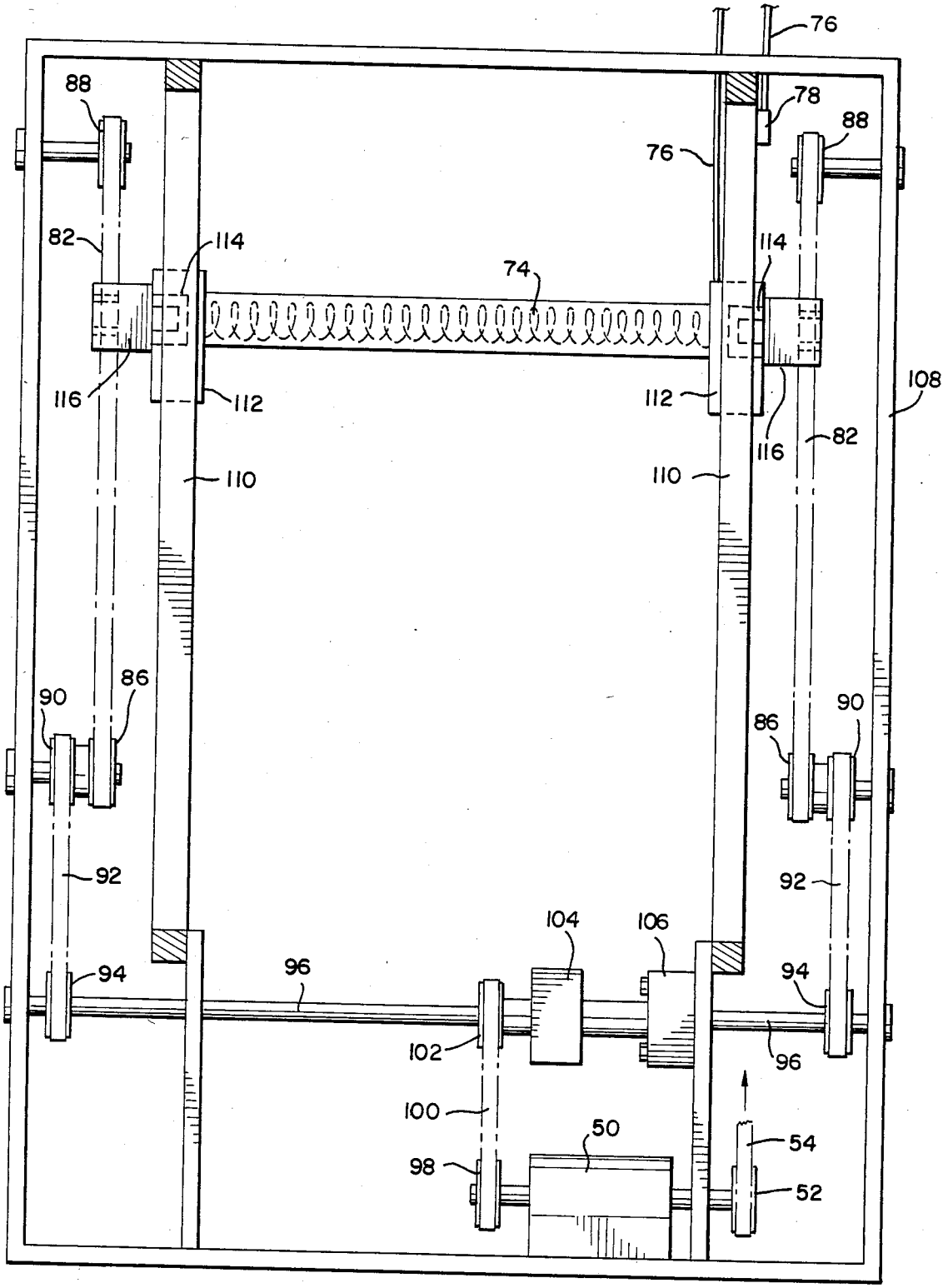
FIG. 5 is an end view of the apparatus for severing packaging material illustrated in FIG. 1.

As shown in FIGS. 1 and 4 in cross section, the severing bar means includes a hollow severing bar 72 made of a flattened metal tube. As best seen in FIG. 5, severing bar 72 includes an internal heating element 74 along its length, which is heated to a high temperature when supplied by electricity. As a result, the heating element 74 heats severing bar 72 to a high temperature.

According to the present invention, there is provided electrical conductor means connected to the heating element in the severing bar means for conducting electricity from a power source to the heating element in the severing bar means to heat the heating element. As shown in FIG. 5, the electrical conductor means includes an insulated electrical conductor 76 which is connected to a power source 78 such as line current which is also used to power other features of the apparatus. As shown in FIG. 1, the electrical conductor 76 forms a large loop which allows it to be played out and taken in during movement of severing bar 72.

According to the present invention, there is provided transport means for translating the severing bar means along a closed path having first and second segments. The first segment generally extends lateral to the extent to the severing bar means and has a component in the conveying direction for passing the severing means across the load path between and along with a first pair of successive loads. The second segment generally extends lateral to the extent of the severing bar means and has a component in the conveying direction for passing the severing means back across the load path between and along with a second pair of successive loads.

As shown in FIGS. 1, 4, and 5 the transport means includes a pair of transport chains 82, each connected to one end of the severing bar 72. Each transport chain 82 is an endless chain which moves along a closed path and passes over a plurality of sprockets 84, 86, and 88. The closed path of transport chain 82 shown in FIGS. 1 and 4 defines a polygon having a plurality of straight sides with sprockets 84, 86 and 88 as vertices of the polygon.

As shown in FIG. 5, sprocket 86 is attached to coaxial sprocket 90 which is connected by chain 92 to sprocket 94 on shaft 96. Shaft 96 is selectively driven by motor and reducer assembly 50 which transmits power through sprocket 98, chain 100 and sprocket 102, which is connected to shaft 96 through clutch 104 and brake 106. This clutch and brake arrangement allows transport chain 82 and therefore severing bar 72 to be selectively transported and stopped at intervals which are synchronized with the transport of the bundles 26.

As can be seen from FIGS. 1 and 4, the closed path of transport chain 82 proceeds in a counter-clockwise direction along a first segment from sprocket 84 to sprocket 86 across the load path between and along with a first pair of successive loads (which in the previous cycle were loads **26*b* and 26*c*, and in the next cycle will be loads 26*d* and 26*e*). The second segment of the closed path extends from sprocket 86 to sprocket 88 (in the previous cycle the severing bar 72 passed along the second segment going upwards between loads 26*c* and 26*d*, and in a subsequent segment cycle will pass upwards between loads 26*e* and 26*f*). The severing bar 72** severs the stretch wrap packaging material between these respective pair of successive loads.

As can be seen from FIG. 1, the first and second segments of the closed path of the severing bar 72 have components in the conveying direction (to the right in FIG. 1) so that the severing bar 72 is conveyed along with each pair of successive loads 26 such that it does not strike the quickly moving loads during its travel.

According to the present invention, there is provided fixed support frame means for supporting the transport means. As shown in FIG. 5, the fixed support frame means includes fixed support frame 108 which is supported by the floor beneath the apparatus and which supports the axles on which sprockets 84, 86, and 88 rotate.

According to the present invention, there is provided means for preventing rotation between the severing bar means and the fixed support means and for preventing twisting of the electrical conductor means during repeated transport of the severing bar means around the closed path.

It is preferable that the means for preventing rotation between the severing bar means and the fixed frame means includes guide frame means attached to the fixed support frame means and extending along the closed path of the transport means, and follower means non-rotatably attached to the severing bar means for non-rotatably engaging the guide frame means. It is also preferable that the means for preventing rotation includes rotary bearing means between the severing bar means and the transport means.

It is further preferable that the guide frame means include slide surface means for engaging the follower means and that the follower means includes slide surface means complementary to the slide surface means of the guide frame means for engaging and sliding relative to the slide surface means of the guide frame means.

It is additionally preferable that the closed path of the transport means defines a polygon having the plurality of straight sides, that the slide surface means of the guide frame means defines a polygon having a plurality of straight sides corresponding to the straight sides of the polygon defined by the closed path, and that the slide surface means of the follower means defines the polygon having a plurality of straight sides corresponding to the straight sides of the polygon defined by the guide frame means.

As shown in FIGS. 1 and 4, the guide frame means portion of the means for preventing rotation includes guide frame 110. Guide frame 110 includes three linear segments, two segments generally extending along the first and second segments of the closed path of the transport means, and a third section connecting the top end of each of the other two sections.

The follower means of the means for preventing rotation between the severing bar means and the fixed support frame means includes a guide follower 112. Guide follower 112 includes a block having a slide surface complementary to a slide surface in the guide frame 110 so that one of the outside surfaces of guide follower 112 follows the adjoining complementary surface of guide frame 110 at all times while guide follower 112 is driven around the closed path defined by transport chain 82. FIG. 4 illustrates these components in various postions along the closed path.

Figure 6:
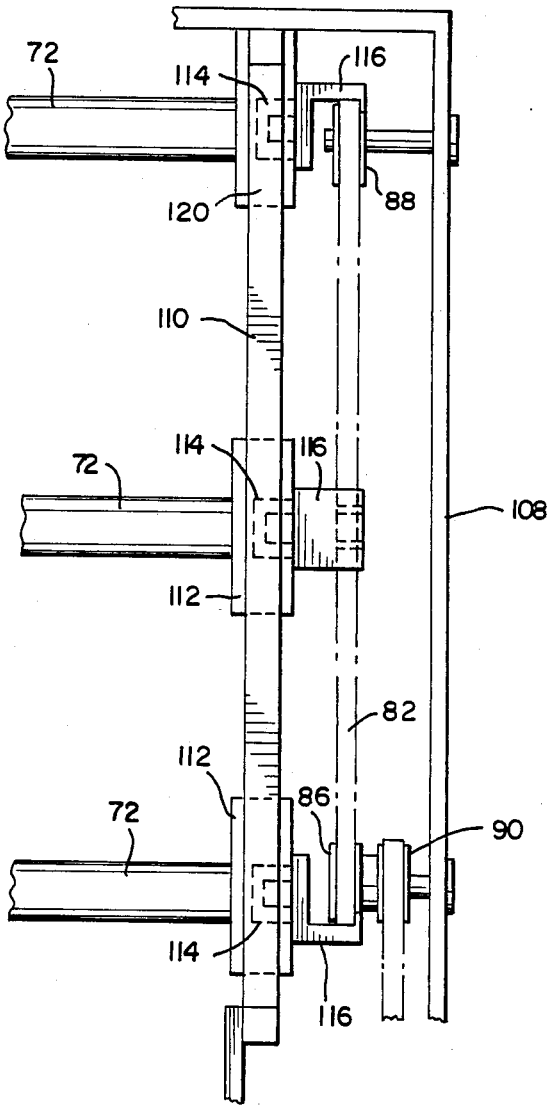
FIG. 6 is a partial end view of the arrangement shown in FIG. 5 in several positions of operation.

Guide follower 112 and severing bar 72 are non-rotatably attached to each other. As shown in FIG. 4, the rotary bearing means includes rotary bearing 114. One of the races of bearing 114 is attached to guide follower 112 and the other race of rotary bearing 114 is attached to a bracket 116 which is attached to transport chain 82 so that guide follower 112 is rotatably attached to transport chain 82. FIG. 6 illustrates these components in various positions along the closed path.

As shown in FIG. 4, the slide surface means of the guide frame means includes straight sides along the inside of guide frame 110. The slide surface means of the follower means includes straight slide surfaces along the top and sides of the outside of guide follower 112.

It is preferable that the transporting means includes bracket means for attaching the severing bar means to the chain at an inward offset equal to the radius of the sprocket so that the severing bar is centered on a sprocket as the severing bar moves along the closed path proximate to the sprocket.

As shown in FIG. 4 and 6, the bracket means includes bracket 116, which is shown in various positions along the closed path. It can be seen that as bracket 116 moves along the closed path proximate to a sprocket that severing bar 72 is centered on the sprocket and undergoes no translation or rotation between each respective pair of positions for the bracket 116 shown at each sprocket 84, 86, 88.

Translation of the severing bar 72 is prevented when the bar is proximate a sprocket by positioning the bracket as just described. Rotation of severing bar 72 is prevented when the bar is proximate a sprocket by the engagement of guide frame 110 and guide follower 112 shown in FIG. 4. This prevents severing bar 72 from rotating relative to fixed support frame 108 during transport. As a result, electrical conductor 76 is not twisted as severing bar 72 is transported around the closed path during cutting of the packaging material.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. Apparatus for severing packaging material which extends between successive wrapped loads during a continuous wrapping process comprising:

conveying means for conveying the wrapped loads along a load path in a conveying direction;

severing bar means extending lateral to said conveying direction for severing the packaging material which extends between the successive wrapped loads, the severing bar means including a heating element for heating the severing bar means to facilitate severing the packaging material;

electrical conductor means connected to the heating element in the severing bar means for conducting electricity from a power source to the heating element in the severing bar means to heat the heating element;

transport means for translating the severing bar means along a closed path having first and second segments, said first segment generally extending lateral to the extent of the severing bar means and having a component in the conveying direction for passing the severing bar means across the load path between and along with a pair of successive loads, said second segment generally extending lateral to the extent of the severing bar means and having a component in the conveying direction for passing the severing bar means back across the load path between and along with a pair of successive loads;

fixed support frame means for supporting the transport means; and means for preventing rotation between the severing bar means and the fixed support frame means and for preventing twisting of the electrical conductor means during repeated transport of the severing bar means around the closed path.

2. The apparatus for severing packaging material as claimed in claim 1 wherein the means for preventing rotation between the severing bar means and the fixed support frame means includes rotary bearing means between the severing bar means and the transport means for permitting relative rotation between the severing bar means and the transport means.

3. The apparatus for severing packaging material as claimed in claim 2 wherein the means for preventing rotation between the severing bar means and the fixed support frame means includes guide frame means attached to the fixed support frame means and extending along the closed path of the transport means, and follower means non-rotatably attached to the severing bar means for non-rotatably engaging the guide frame means.

4. The apparatus for severing packaging material as claimed in claim 3 wherein the guide frame means includes slide surface means for engaging the follower means, and wherein the follower means includes slide surface means complementary to the slide surface means of the guide frame means for engaging and sliding relative to the slide surface means of the guide frame means.

5. The apparatus for severing packaging material as claimed in claim 4 wherein the closed path defines a polygon having a plurality of straight sides, wherein the slide surface means of the guide frame means defines a polygon having a plurality of straight sides corresponding to the straight sides of the polygon defined by the closed path, and wherein the slide surface means of the follower means defines a polygon having a plurality of straight sides corresponding to the straight sides of the polygon defined by the guide frame means.

6. The apparatus for severing packaging material as claimed in claim 5 wherein the transporting means includes a chain and sprocket assembly in which the chain follows the closed path.

7. The apparatus for severing packaging material as claimed in claim 6 wherein the chain and sprocket assembly includes a plurality of sprockets defining vertices of the polygon defined by the closed path.

8. The apparatus for severing packaging material as claimed in claim 7 wherein the transporting means includes bracket means for attaching the severing bar means to the chain at an inward offset equal to the radius of the sprockets so that the severing bar mean is centered on a sprocket as the severing bar moves along the closed path proximate to the sprocket.

9. The apparatus for severing packaging material as claimed in claim 1 wherein the pair of loads between which the severing bar means passes on the first segment is a first pair of loads, and wherein the pair of loads between which the severing bar means passes on the second segment is a second pair of loads.

10. A method for severing packaging material which extends between successive wrapped loads during a continuous wrapping process comprising:

conveying wrapped loads along a load path in a conveying direction;

heating a severing bar which extends lateral to the conveying direction by providing electricity from a power source through an electrical conductor to a heating element in the severing bar;

transporting the severing bar along a closed path having first and second segments in which the first segment generally extends lateral to the extent of the severing bar and has a component in the conveying direction for passing the severing bar between and along with a pair of successive loads, and in which the second segment generally extends lateral to the extent of the severing bar and has a component in the conveying direction for passing the severing bar back across the load path between and along with a pair of succesive loads; and preventing rotation between the severing bar and a fixed support frame to prevent the electrical conductor from twisting during repeated transport of the severing bar around the closed path.

11. The method for severing packaging material as claimed in claim 10 wherein the step of preventing rotation between the severing bar and the fixed support frame includes permitting relative rotation between the severing bar and the transport for the severing bar.

12. The method of severing packaging material as claimed in claim 10 wherein the pair of loads between which the severing bar passes on the first segment is a first pair of loads, and wherein the pair of loads between the severing bar passes on the second segment is a second pair of loads.

* * * * *